US005197703A

United States Patent [19]

Pratolongo

[11] Patent Number: 5,197,703

[45] Date of Patent: Mar. 30, 1993

[54] CONCEALED SUPPORT DEVICE TO FASTEN A SHELF TO A WALL

[75] Inventor: Modesto Pratolongo, Milan, Italy

[73] Assignee: Lema S.P.A., Como, Italy

[21] Appl. No.: 690,653

[22] Filed: Apr. 24, 1991

[30] Foreign Application Priority Data

May 4, 1990 [IT] Italy ..... 20209 A/90

[51] Int. Cl.[5] ..... A47B 96/06

[52] U.S. Cl. ..... 248/225.1; 108/152; 211/90

[58] Field of Search ..... 248/225.2, 225.1, 235, 248/250; 211/90, 88, 105.1, 105.2; 52/36, 239; 312/245; 108/152, 108

[56] References Cited

U.S. PATENT DOCUMENTS

| | | | |
|---|---|---|---|
| 1,779,236 | 1/1930 | Hoegger | 211/90 X |
| 1,922,345 | 8/1953 | Bauch | 248/225.1 |
| 3,946,979 | 3/1976 | Ehlebracht | 312/245 X |
| 4,422,616 | 12/1983 | Wilke | 248/250 X |
| 4,576,355 | 3/1986 | Graf | 312/245 X |
| 4,587,774 | 3/1986 | Wendt | 52/36 |
| 4,709,892 | 12/1987 | Gurgui | 108/152 X |
| 4,817,538 | 4/1989 | Michaelsen | 52/239 X |
| 5,004,200 | 4/1991 | Walz | 211/90 X |
| 5,090,652 | 2/1992 | Cattaneo | 312/245 X |

FOREIGN PATENT DOCUMENTS

| | | | |
|---|---|---|---|
| 3831968 | 3/1990 | Fed. Rep. of Germany | 108/152 |

*Primary Examiner*—J. Franklin Foss
*Attorney, Agent, or Firm*—Laff, Whitesel, Conte & Saret

[57] ABSTRACT

The device is comprised of a plate (2) secured to a wall (3) and exhibiting an engagement recess (12) into which an end portion (11) of a supporting arm (8) on which the shelf (10) is mounted, is oscillatably introduced. An adjusting cam member (15) operable through a hole (25) formed in the shelf (10) acts between the supporting arm (8) and the plate (2) for adjusting the arm inclination and therefore the shelf inclination in a transverse direction. A set pin (21) acts between the plate (22) and the cam element (15) for adjusting the vertical positioning of the arm and therefore the shelf inclination in a longitudinal direction.

10 Claims, 2 Drawing Sheets

CONCEALED SUPPORT DEVICE TO FASTEN A SHELF TO A WALL

BACKGROUND OF THE INVENTION

1. Field of the Invention

The present invention relates to a concealed support device of the type commonly used to fasten wooden supporting shelves or the like to a wall in cantilevered fashion.

It is known that concealed support devices of the above type consist of metal bars of a polygonal section provided at one end thereof with a threaded shank by which they come in engagement with a screw anchor previously fitted in the wall. The shelves to be applied to the wall are provided along the side designed to abut against the wall itself, with transverse holes into which the support bars will be engaged.

2. Prior Art

This shelf supporting system while aesthetically agreeable, involves a series of drawbacks and difficulties as far as the mounting thereof is concerned, in that holes in the wall need to be carried out in a very precise manner.

In this connection it is to be noted that the precise execution of the holes is of very difficult achievement, above all when the operator is not very skilled. In fact it may easily happen that the drill does not enter the wall in a perfectly perpendicular direction and/or is deflected if, for example, its introduction into the wall occurs at the junction point of two bricks by cement.

All the foregoing obviously brings about an important loss of time because if the holes are not carried out in a precise manner, as a result the shelves will not be properly positioned but they will often exhibit both a longitudinal and transverse inclination.

It addition it is noted that the threaded shanks of the metal bars are submitted to high stresses by effect of the shelf weight to which it is necessary to add that of the objects placed thereon. Consequently, even where the shelf is mounted in a correct manner, slight yieldings are possible, due to the settling down of the support device under load, which yieldings can make the shelf take an inclined position.

SUMMARY OF THE INVENTION

It is an object of the present invention to solve the problems of the known art, by providing a concealed support device such arranged that it enables an easy and precise installation and a subsequent adjustment of the shelf inclination, both in the longitudinal and transverse direction, when the mounting is completed.

The foregoing and further objects that will become more apparent in the course of the present description are substantially attained by a concealed support device to fasten a shelf to a wall, comprising: a plate designed to be fastened to a wall; a supporting arm insertable longitudinally in a housing provided in a shelf and having a hooking end oscillatably fixed to an engagement recess offered by the plate; an adjusting member comprising a cam element rotatably engaged to the arm and designed to act against said plate to restrain the angular displacement of the arm about the hooking end; a vertical set pin operatively engaged to the plate and acting against the cam element so as to give the desired vertical positioning to the supporting arm.

BRIEF DESCRIPTION OF THE DRAWINGS

Further features and advantages will be best understood from the detailed description of a preferred embodiment of a concealed support device to fasten a shelf to a wall in accordance with the present invention, given hereinafter by way of non-limiting example with reference to the accompanying drawings, in which.

DESCRIPTION OF THE PREFERRED EMBODIMENT

Figure 1:
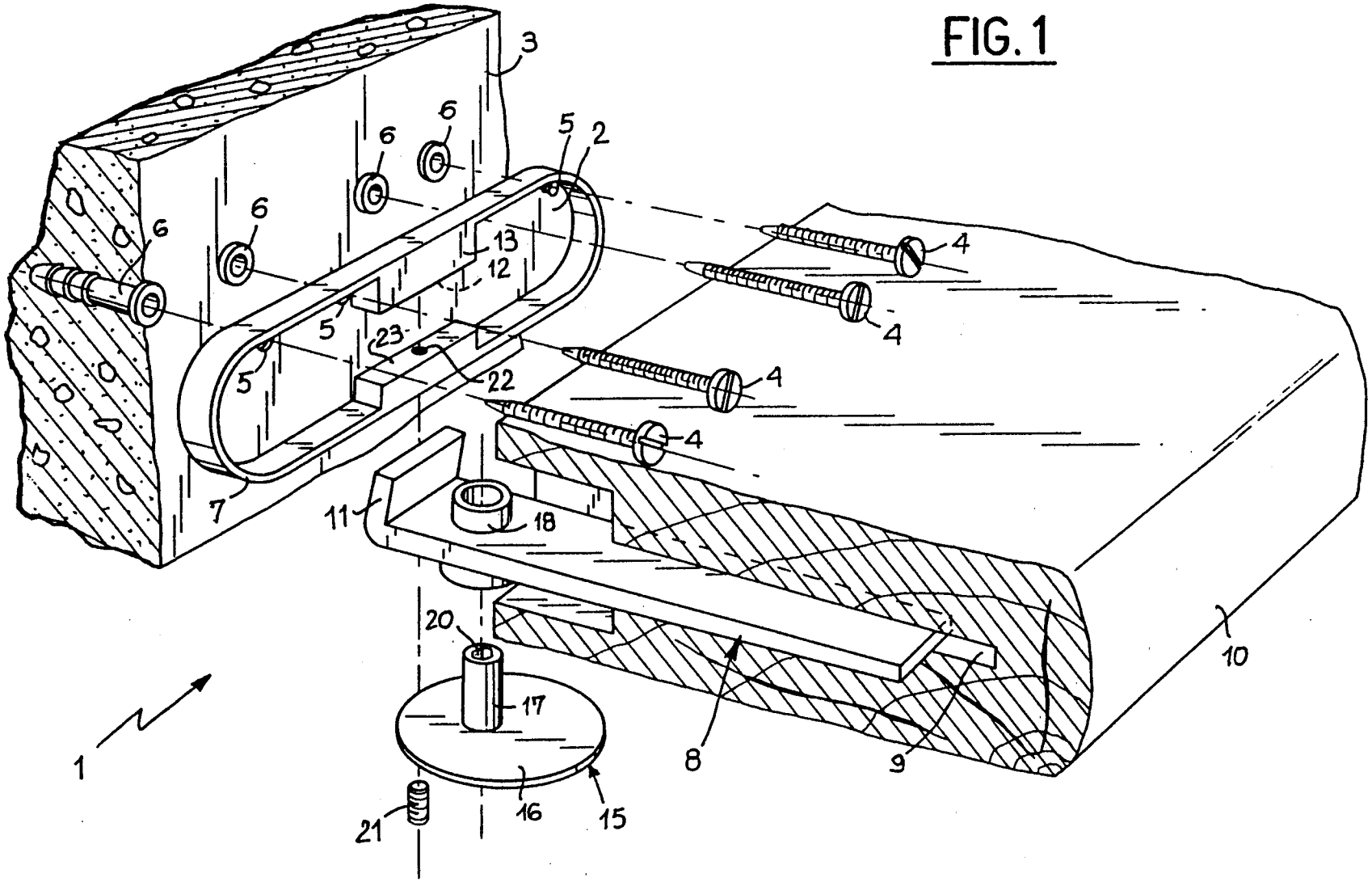
FIG. 1 is an exploded perspective view of a support device in accordance with the invention.

Referring to the drawings, a concealed support device to fasten a shelf to a wall in accordance with the invention has been generally identified by reference numeral 1.

The support device 1 is comprised of a plate 2 adapted to be fastened to a wall 3 by a plurality of threaded elements 4 extending across holes 5 formed in the plate. The threaded elements 4 are operatively engaged in screw anchors 6 fitted in the wall 3 in order to achieve the fastening of the plate 2. In the embodiment of the invention the threaded elements 4 are in the number of four, at least two of them being engaged in the upper part of the plate 2 for the known reasons of enabling the structure to resist stresses.

Preferably the plate 2 also has a perimetrical rim 7 projecting perpendicularly away from the wall 3, to the ends better clarified in the following.

Associated with the plate 2 is a supporting arm 8 so shaped that it can be longitudinally inserted in a housing 9 provided in a shelf 10 to be fastened to the wall 3. The arm 8 has a hooking end 11 bent at right angles to the arm itself, which lends itself to be oscillatably fixed to an engagement recess 12 offered by the plate 2. In the embodiment shown the engagement recess 12 is formed within a block 13 projecting from the plate 2 and extends along the upper side of the plate.

Figure 2:
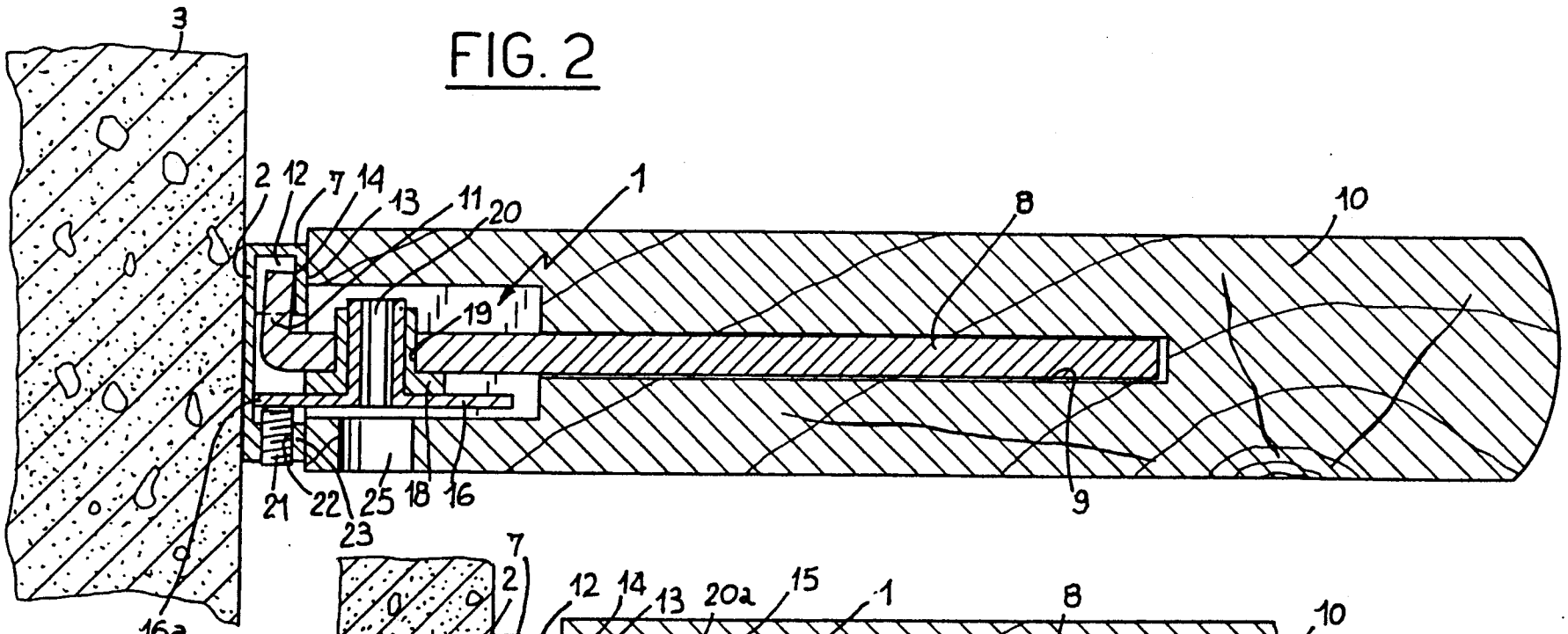
FIG. 2 is a section showing the support device in use.
Figure 3:
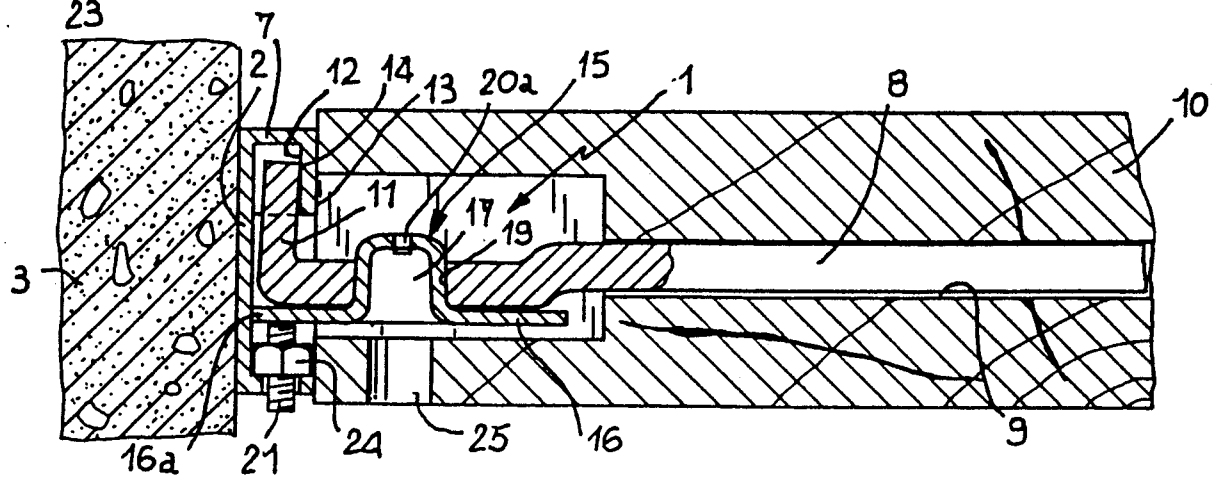
FIG. 3 is a broken away section showing an alternative embodiment of the device in question.

As clearly viewed from FIGS. 2 and 3, the engagement of the hooking end 11 in the recess 12 takes place so that said end is capable of angular oscillation according to a horizontal axis about the point denoted by 14 as well as of sliding in a substantially vertical direction.

The supporting arm 8 is provided, close to the hooking end 11, with an adjusting member 15 comprising a cam element 16 rotatably engaged to the arm and designed to act, by its perimetrical edge **16*a*, against the plate 2. In this manner, the cam element 16 reacts against the plate 2 for the purpose of stopping the downward angular displacement of the supporting arm 14 about point 14, at which point the contact between the hooking end 11 and the recess 12** occurs.

Preferably the cam element 16 has a circular configuration and is engaged to the supporting arm 8 by an eccentric pin 17. In one embodiment, shown in FIGS. 1 and 2, this eccentric pin 17 is operatively fitted in a bushing 18 accommodated in a hole 19 offered by the supporting arm 8 and is provided with a polygonal housing 20 adapted to engage an Allen spanner by which it is possible to rotate the adjusting member 15 so as to alter the inclination of the supporting arm 8.

In the embodiment shown in FIG. 3, the pin 17 is on the contrary of one piece construction with the cam element and is obtained through a combined shearing and drawing action. In this case the pin 17 is also directly engaged in the hole 19 of the supporting arm 8 and has a slot 20*a* at the upper part thereof into which the tip of a screwdriver or the like can be inserted in order to carry out the movement of the adjusting member 15.

Still in accordance with the present invention, the presence of a vertical set pin 21 is also provided; it is operatively engaged to the plate 2 and acts against the cam element 16 to give the desired vertical positioning to the supporting arm 8. In greater detail, in the embodiment shown in FIGS. 1 and 2, the set pin 21 is operatively engaged in a threaded housing 22 formed in a lug 23 projecting from the plate 2 at the base side thereof. In the alternative embodiment shown in FIG. 3 the set pin 21 is instead provided to be operatively engaged in a nut 24 made integral with the plate 2, for example by welding.

After the above description, the mode of use of the support device of the invention appears very simple.

It is to be pointed out that in most cases at least two support devices 1 in accordance with the invention will be associated with the shelf 10 to be fastened to the wall 3 and they will be disposed close to the opposite ends of the shelf respectively.

After the plates 2 have been fastened to the wall 3 by the threaded elements 4 and the screw anchors 6, the supporting arms 8 are engaged, by their hooking ends 11, into the engagement recesses 12 offered by the respective plates. At this point the arms 8 lend themselves to be engaged in the corresponding housings 9 exhibited by the shelf 10 which will be urged against the wall 3 as far as it abuts on the perimetrical rims 7 of the respective plates 2. Then the adjustment of the shelf inclination will be carried out both in the transverse and longitudinal directions.

The inclination adjustment in the transverse direction is achieved by rotating the cam element 16 with the aid of an Allen spanner or another appropriate tool which is introduced into the housing/slot, 20, 20*a* of the pin 17 through a through hole 25 formed in the shelf 10 at the lower part thereof. This operation is carried out on the supporting arms 8 of both devices.

The adjustment of the longitudinal inclination of the shelf 10 is instead achieved by merely acting on the vertical set pins 21 of both devices 1. In fact each set pin lends itself to be driven in rotation so as to modify the vertical positioning of the respective supporting arm 8. Therefore the shelf 10 will be oriented according to a perfectly horizontal plane when, by means of the set pins 21, the arms 8 of both devices 1 are brought exactly to the same level with respect to each other.

The present invention attains the intended purposes.

It is in fact to be noted that the device in question enables the easy installation of the shelves even by an unskilled person, since the adjustment of the shelf inclination both in the transverse and longitudinal direction can be achieved with ease after the installation has taken place.

The device in reference also offers the advantage of allowing the shelf flatness to be restored when settling down under load has occurred.

Obviously modifications and variations can be made to the invention as conceived, all of them falling within the scope of the inventive idea.

What is claimed is:

1. A concealed support device to fasten a shelf to a wall, comprising:

a plate designed to be fastened to a wall;

a supporting arm longitudinally insertable in a housing provided in a shelf and having a hooking end oscillatably fixed to an engagement recess offered by the plate;

an adjusting member comprising a cam element rotatably engaged to the arm and designed to act against said plate to restrain the angular displacement of the arm (8) about the hooking end (11); and a vertical set screw operatively engaged to the plate and acting against the cam element so as to give the desired vertical positioning to the supporting arm.

2. The device as claimed in claim 1, wherein the hooking end of the supporting arm is bent perpendicularly to the arm and is engaged in the engagement recess in a manner enabling it to oscillate about a horizontal axis and slide in a substantially vertical direction.

3. The device as claimed in claim 1, wherein said cam element has a circular configuration and is rotatably engaged to the supporting arm by means of an eccentric pin.

4. The device as claimed in claim 3, wherein said eccentric pin is operatively housed in a bushing engaged in a hole formed in the supporting arm.

5. The device as claimed in claim 3, wherein the eccentric pin is of one piece construction with the cam element and is formed with a shearing and drawing operation.

6. The device as claimed in claim 1, wherein said engagement recess is formed in a block projecting from the plate and extending along the top side thereof.

7. The device as claimed in claim 1, wherein the vertical set pin is operatively engaged in a lug projecting at right angles from the plate at the base side thereof.

8. The device as claimed in claim 1, wherein the vertical set pin is operatively engaged in a nut fastened to the plate close to the base side thereof.

9. The device as claimed in claim 1, wherein said plate has a perimetrical rim projecting perpendicularly away from the wall so as to offer an abutment seat to the shelf.

10. The device as claimed in claim 1, wherein said plate is fastened to the wall by at least two threaded elements crossing the plate at the top side thereof and engaging in respective screw anchors fitted in the wall.

* * * * *